US007845577B2

(12) United States Patent
Hermann et al.

(10) Patent No.: US 7,845,577 B2
(45) Date of Patent: Dec. 7, 2010

(54) INFLATABLE AUTOMATIVE TRACTION RECOVERY DEVICE

(75) Inventors: Dan Hermann, Ramat Hasharon (IL); Eyal Benjamin, Or Yehuda (IL)

(73) Assignee: Pillwtrack Ltd., Or Yehuda (IL)

( * ) Notice: Subject to any disclaimer, the term of this patent is extended or adjusted under 35 U.S.C. 154(b) by 294 days.

(21) Appl. No.: 11/834,000

(22) Filed: Aug. 5, 2007

(65) Prior Publication Data

US 2009/0032606 A1 Feb. 5, 2009

(51) Int. Cl.
*E01B 23/00* (2006.01)

(52) U.S. Cl. ..... 238/14; 152/208

(58) Field of Classification Search ..... 238/14
See application file for complete search history.

(56) References Cited

U.S. PATENT DOCUMENTS

| | | | | |
|---|---|---|---|---|
| 1,617,271 | A * | 2/1927 | Penfield | 238/14 |
| 3,999,879 | A * | 12/1976 | Stachiw et al. | 404/73 |
| 4,106,149 | A * | 8/1978 | Larsson | 14/27 |
| 4,795,093 | A * | 1/1989 | Kozelnicky | 238/14 |
| 5,332,152 | A * | 7/1994 | Alwafaie et al. | 238/14 |
| 6,696,122 | B1 * | 2/2004 | Deschamps | 428/36.1 |
| 2009/0032606 | A1 * | 2/2009 | Hermann et al. | 238/14 |

FOREIGN PATENT DOCUMENTS

| | | |
|---|---|---|
| WO | WO2006/053374 | 5/2006 |
| WO | WO 2006053374 A1 * | 5/2006 |

* cited by examiner

*Primary Examiner*—S. Joseph Morano
*Assistant Examiner*—Jason C Smith
(74) *Attorney, Agent, or Firm*—Mark M. Friedman

(57) ABSTRACT

Disclosed is an inflatable cushion configured with a substantially flattened tubular shape such that in an inflated state the inflatable cushion is highly adaptable so as to readily conform to the terrain of the underlying surface on which it is deployed and to the footprint of the vehicle tire as the vehicle is driven across the device. During typical use the cushion is not fully inflated and operational inflation pressure is generally less than 10 PSI and preferably 5 PSI. For use the cushion is deployed such that the central axis of the tube is substantially parallel to the driving direction of the vehicle. The inflatable automotive traction recovery tool of the present invention simultaneously lifts the vehicle and provides a driving surface with sufficient pressure against the tire and underlying surface to allow the vehicle to drive on it. The inflatable automotive traction recovery tool of the present invention is able to negotiate a wide variety of obstacles such as, but not limited to, bridging over a ditch, providing a ramp to climb a steep step, providing traction on soft ground and low friction surfaces, and providing support when one or more wheels of the vehicle lose contact pressure with the ground.

23 Claims, 8 Drawing Sheets

FIG. 11A
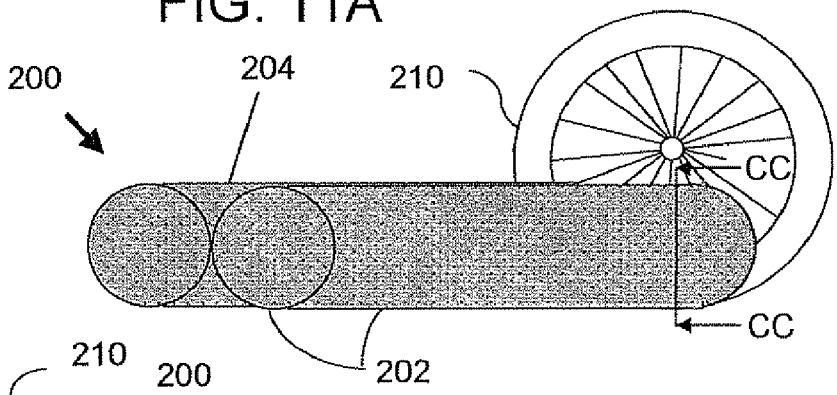
FIG. 11B
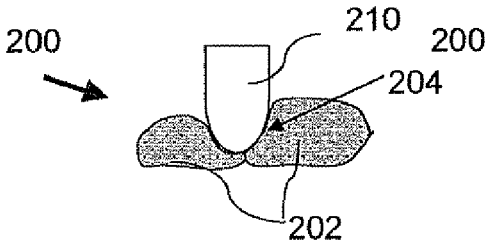
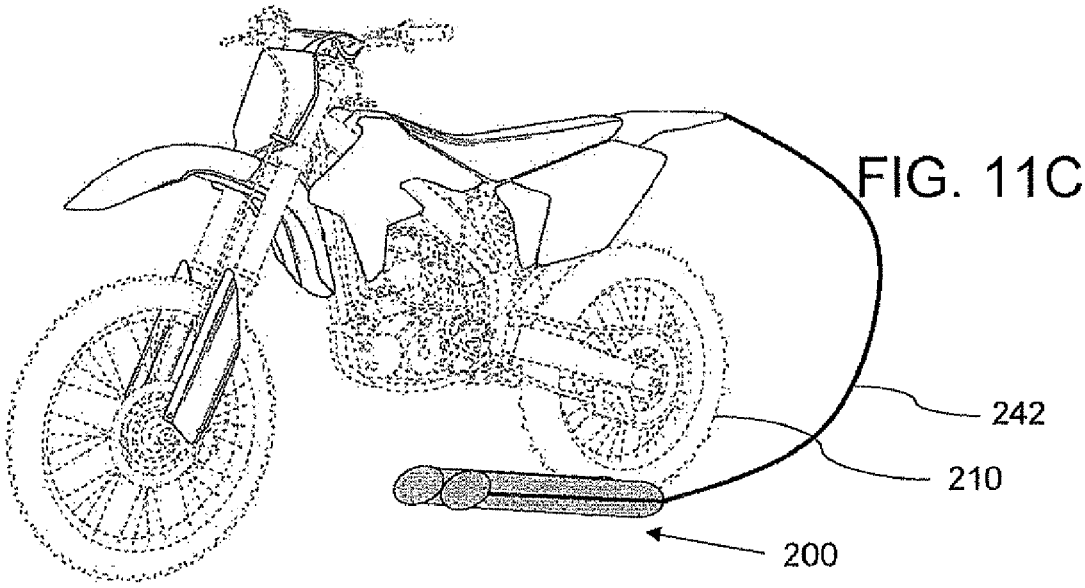
FIG. 11C

INFLATABLE AUTOMATIVE TRACTION RECOVERY DEVICE

FIELD AND BACKGROUND OF THE INVENTION

The present invention relates to devices that assist in the recovery of lost traction by automobiles and, in particular, it concerns an inflatable automotive traction recovery device.

There are numerous inflatable devices intended for uses associated with motor vehicles. Among these devices are inflatable jacks, ramps, leveling devices and roadways. All of these devices are configured to assume or maintain a predetermined shape at operational air pressure. For example U.S. Pat. No. 3,999,879 employs internal strands and partitioning walls to maintain a predetermined distance between its top and bottom surfaces. Inflatable jacks are typically cylindrical or rectangular in shape. Ramps by definition assume a generally wedge shape. Leveling devices by necessity usually have a substantially rectangular cross-sectional contour so as to provide a stable level surface on which to support the vehicle.

There is therefore a need for inflatable automotive traction recovery device that is highly adaptable so as to readily conform to the terrain of the underlying surface on which it is deployed and to the footprint of the vehicle tire as the vehicle is driven across the device.

SUMMARY OF THE INVENTION

The present invention is highly adaptable so as to readily conform to the terrain of the underlying surface on which it is deployed and to the footprint of the vehicle tire as the vehicle is driven across the device.

According to the teachings of the present invention there is provided, a method for providing an alternative driving surface for a motor vehicle, the alternative driving surface being an inflatable automotive traction recovery device deployable on an underlying surface, the method comprising: a) providing at least one inflatable cushion; b) deploying the at least one inflatable cushion in an un-inflated state forward of, and adjacent to, at least one wheel on the motor vehicle in a desired direction of locomotion; c) inflating the at least one cushion so as to simultaneously lift the vehicle and provide a driving surface; and e) driving the motor vehicle on a top surface of the inflatable cushion.

According to a further teaching of the present invention, the at least one inflatable cushion is implemented such that in an operationally-inflated state a bottom surface of the inflatable cushion is highly adaptable so as to substantially conform to the terrain of the underlying surface and a top surface of the inflatable cushion is highly adaptable so as to substantially conform to a contour of a vehicle tire.

According to a further teaching of the present invention, the at least one inflatable cushion is implemented having a substantially flattened tubular shape.

According to a further teaching of the present invention, the driving is in a direction that is substantially parallel to a central axis of the substantially flattened tubular shape.

According to a further teaching of the present invention, the at least one inflatable cushion is implemented as a fold sheet of material such that the inflatable cushion has one folded side and is sealed along the edges of its remaining three open sides.

According to a further teaching of the present invention, the inflating of the cushion is to an operational pressure of between 1-8 PSI According to a further teaching of the present invention, the at least one inflatable cushion is implemented as two parallel substantially tube-like cushion elements that are interconnected along substantially their entire length so as to form between them a groove in which at least one tire of the vehicle is driven.

According to a further teaching of the present invention there is also provided, providing at least one traction element attached to the top surface of the at least one inflatable cushion.

According to a further teaching of the present invention, there is also provided attaching a plurality of the inflatable cushions so as to increase a drivable area.

There is also provided according to the teachings of the present invention, a method for providing an alternative driving surface for a motor vehicle, the alternative driving surface being an inflatable automotive traction recovery device deployable on a underlying surface, the method comprising: a) providing at least one inflatable cushion configured such that in an operationally-inflated state the at least one inflatable cushion is highly adaptable so as to substantially conform to the terrain of the underlying surface and a top surface of the inflatable cushion is highly adaptable so as to substantially conform to a contour of a vehicle tire; and b) driving the motor vehicle on a top surface of the at least one inflatable cushion while the at least one inflatable cushion is in the operationally-inflated state.

According to a further teaching of the present invention, there is also provided driving the motor vehicle on the top surface of the at least one inflatable cushion is in a direction that is substantially parallel to a central axis of a substantially flattened tubular shape of the cushion.

According to a further teaching of the present invention, the at least one inflatable cushion is implemented as two parallel substantially tube-like cushion elements that are longitudinally interconnected along substantially their entire length so as to form between them a groove in which at least one tire of the vehicle is driven.

There is also provided according to the teachings of the present invention, an inflatable automotive traction recovery device for use with a motor vehicle on a underlying surface, the inflatable automotive traction recovery device comprising at least one inflatable cushion configured with a bottom surface that is highly adaptable so as to substantially conform to the terrain of an underlying surface and a top surface that is highly adaptable so as to substantially conform to a contour of a vehicle tire, such that inflating the at least one cushion simultaneously lifts the motor vehicle and provides a driving surface.

According to a further teaching of the present invention, the cushion has a substantially flattened tubular shape.

According to a further teaching of the present invention, a preferred driving direction is substantially parallel to a central axis of the substantially tubular shape.

According to a further teaching of the present invention, the cushion is fabricated from a sheet of material that is folded on itself and sealed along the edges of its remaining three open sides.

According to a further teaching of the present invention, the at least one inflatable cushion is configured as two parallel substantially tube-like cushion elements that are longitudinally interconnected along substantially their entire length so as to form between them a groove in which at least one tire of the vehicle is driven.

According to a further teaching of the present invention, the top surface includes at least one traction element.

According to a further teaching of the present invention, there is also provided at least one attachment element configured to facilitate attachment of a plurality of the inflatable cushions so as to increase a drivable area.

According to a further teaching of the present invention, the at least one inflatable cushion is inflatable by the introduction of pressurized air into an interior volume of the cushion.

According to a further teaching of the present invention, the at least one inflatable cushion is inflatable by the introduction of pressurized liquid into an interior volume of the cushion.

According to a further teaching of the present invention, the at least one inflatable cushion is inflatable by the introduction of a foam into an interior volume of the cushion.

According to a further teaching of the present invention, there is also provided a vehicle jacking adaptor configured for deployment on the top surface of the inflatable cushion for deployment in association with a vehicle, with the vehicle jacking adaptor spanning at least a portion of a distance between the top surface of the inflatable cushion in an un-inflated stated and a jacking point on a vehicle, and as the inflatable cushion is inflated the jacking adaptor contacts the jacking point and at least a portion of the vehicle is lifted.

BRIEF DESCRIPTION OF THE DRAWINGS

The invention is herein described, by way of example only, with reference to the accompanying drawings, wherein:

FIG. 11A is a schematic isometric illustration of a third preferred embodiment of an inflatable automotive traction recovery device, constructed and operational according to the teachings of the present invention, this embodiment be for use with a two-wheeled vehicle;

FIG. 11B is a cross-sectional view of the embodiment of FIG. 11A taken along line CC; and FIG. 11C is an illustration of the embodiment of FIG. 11A in use.

DESCRIPTION OF THE PREFERRED EMBODIMENTS

The present invention is highly adaptable so as to readily conform to the terrain of the underlying surface on which it is deployed and to the footprint of the vehicle tire as the vehicle is driven across the device.

The principles and operation of an inflatable automotive traction recovery device according to the present invention may be better understood with reference to the drawings and the accompanying description.

Figure 1A:
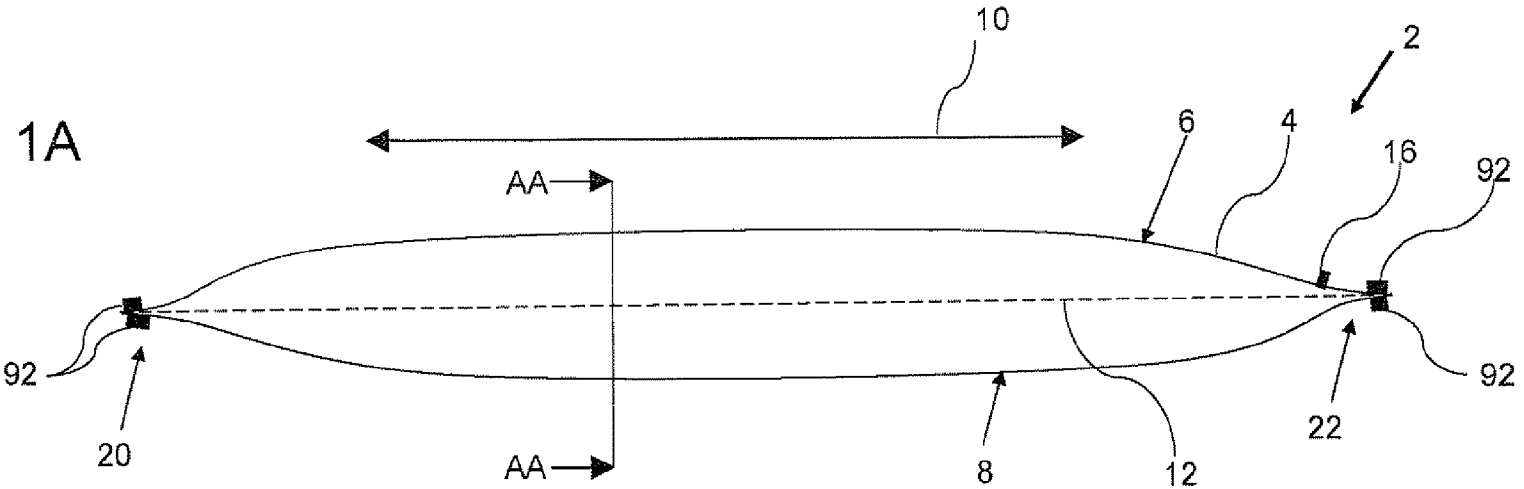
FIG. 1A is a schematic longitudinal cross section of a first preferred embodiment of an inflatable automotive traction recovery device, constructed and operational according to the teachings of the present invention.
Figure 1C:
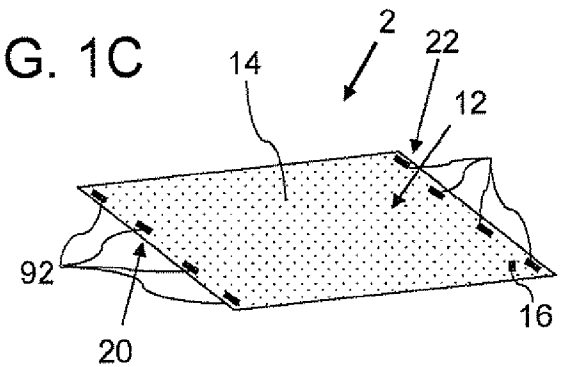
FIG. 1C is a schematic isometric illustration of the inflatable automotive traction recovery device of FIG. 1A shown in an un-inflated state.
Figure 2A:
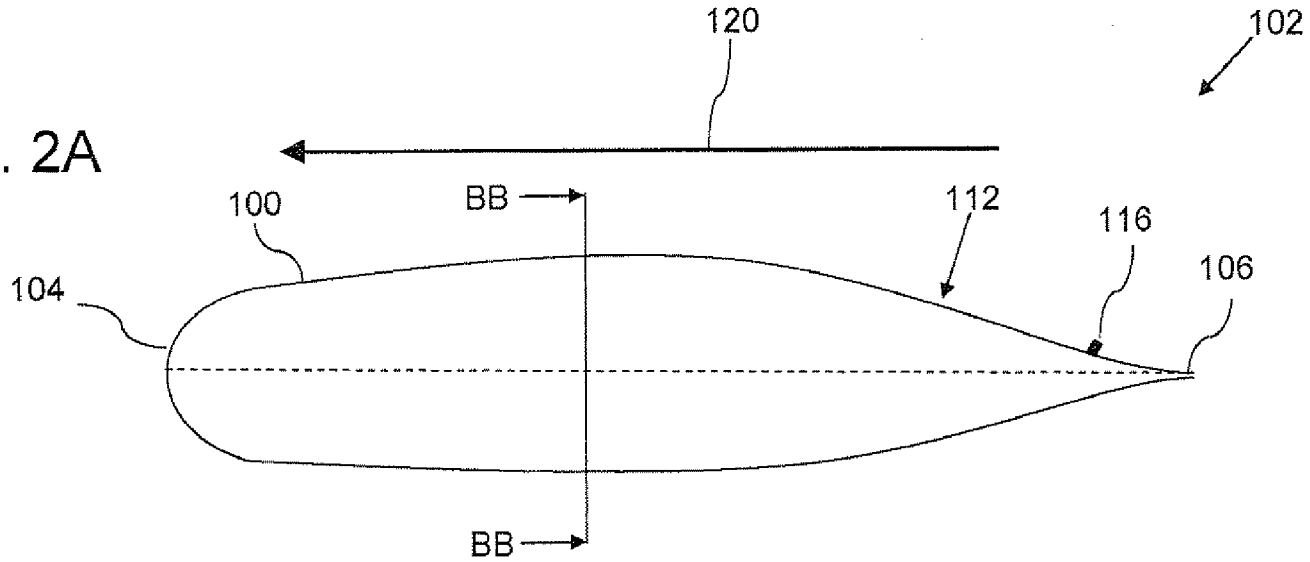
FIG. 2A is a schematic longitudinal cross section of a second preferred embodiment of an inflatable automotive traction recovery device, constructed and operational according to the teachings of the present invention.
Figure 2B:
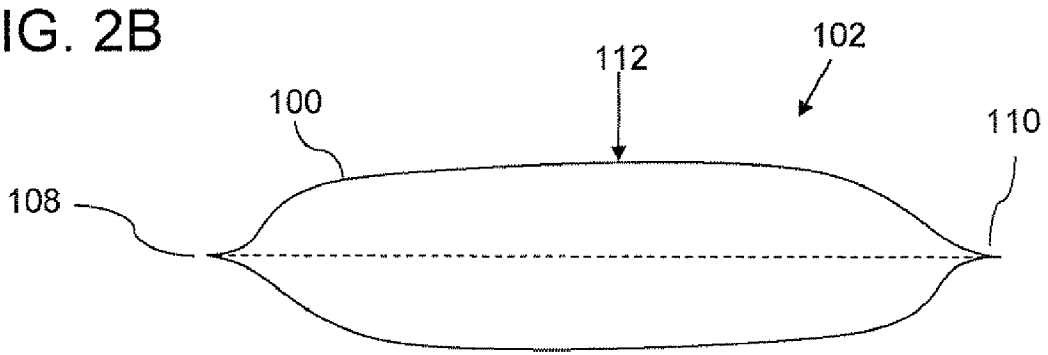
FIG. 2B is a schematic cross section of the inflatable automotive traction recovery device of FIG. 1A taken along line BB.
Figure 2C:
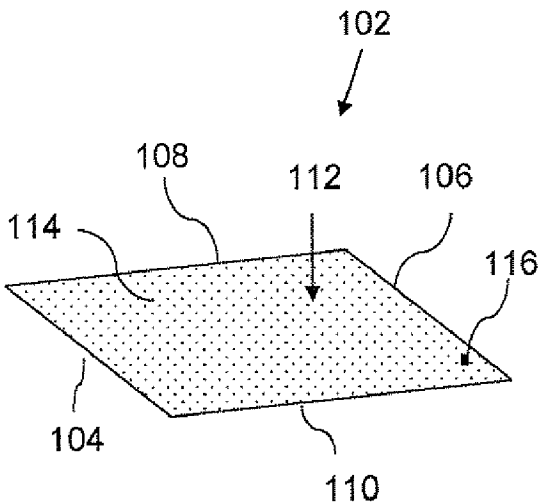
FIG. 2C is a schematic isometric illustration of the inflatable automotive traction recovery device of FIG. 2A shown in an un-inflated state.

By way of introduction, each of the preferred embodiments of the inflatable automotive traction recovery device of the present invention are generally configured as an inflatable cushion that, when deflated, assumes the shape of a substantially rectangular mat, as illustrated in FIGS. 1C and 2C. In an operationally-inflated state, however, the bottom surface of the inflatable cushion is highly adaptable so as to readily conform to the terrain of the underlying surface and the top surface of the inflatable cushion is highly adaptable so as to readily conform to the contour of the vehicle tire.

Herein, the phrase "highly adaptable so as to readily conform to the terrain of the underlying surface" is used to describe the characteristic of being highly flexible in substantially all directions thereby allowing the walls of the cushion to mold to and accommodate substantially any ground surface contour and the contour of the vehicle tire when the weight of the vehicle is supported by the cushion. It should be noted that the cushion of the present invention does not include any interior structures that limit the adaptability of the walls to the underlying surface or the contour of the vehicle tire. Therefore, the shape of the inflated cushion during operational use is defined by the shape of the walls (i.e. square, rectangle, circle, triangle, by non-limiting example) and the contour of the underlying surface and the vehicle tire.

Figure 1B:
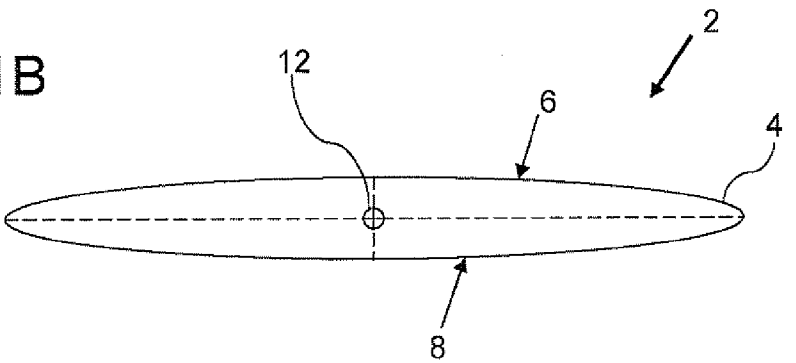
FIG. 1B is a schematic cross section of the inflatable automotive traction recovery device of FIG. 1A taken along line AA.

Herein will be discussed two preferred embodiments of the inflatable automotive traction recovery device of the present invention. A first preferred embodiment, as illustrated in FIGS. 1A and 1B is fabricated from a generally tubular shapes material that is closed at both ends. The second preferred embodiment, as illustrated in FIGS. 2A and 2B is fabricated from a single sheet of material folded over on itself and closed along the three resulting open edges. Such closure may be by use of, but not limited to, stitching, adhesives, material welding, clamping configurations and the like. Alternatively, the cushion may be constructed by knitting a closed sack around an inner inflatable element. It will be appreciated that although FIGS. 3A-10 illustrate the function of the present invention by illustrating the embodiment of FIGS. 1A and 1B, this is not intended as a limitation and the embodiment of FIGS. 2A and 2B, as well as any subsequent embodiments of the present invention, will function in substantially the same manner.

The cushion itself is fabricated from material that is impermeable (i.e., air tight), highly flexible and non-stretching. It should be noted that the cushion may be configured for direct deployment or for deployment in a protective envelope. Alternatively, the cushion may be fabricated from material that is highly flexible and non-stretching yet permeable, into which an inflatable bladder is inserted. The inflatable bladder may be fabricated from a stretchable material such as, but not limited to, rubber. Alternatively, the bladder may be fabricated from non-stretching material such as, but not limited to, nylon.

One feature unique to the inflatable automotive traction recovery tool of the present invention is the ability to adopt its shape to the shape of the cavity between the vehicle wheel and the ground. That is to say, the inflatable cushion of the present invention provides conformity of its bottom surface to the terrain of the ground on which it is deployed. It will be appreciated that the inflatable automotive traction recovery tool of the present invention can be easily deployed into any cavity, even while it is folded, and then inflated until it adopts the shape of the cavity and applies sufficient pressure to both the tire and the underlying surface to provide sufficient traction for the vehicle to drive.

The cushion of the present invention also provides conformity of its top surface to the footprint of the vehicle tire as the vehicle is driven across the device. By adopting the shape of the tire the inflatable cushion of the present invention provides higher traction since it wraps around the tire.

In use, the un-inflated cushion is deployed forward of and adjacent to, the problematic wheel and then inflated until sufficient pressure is supplied to both the underlying surface and the tire to allow the vehicle to drive on the top surface of the cushion. In this way, the inflatable automotive traction recovery tool of the present invention simultaneously lifts the vehicle and provides a driving surface with sufficient pressure against the tire and the underlying surface to allow the vehicle to drive on it. During typical use, the cushion is supporting at least a portion of the weight of the vehicle when it reaches operational inflation pressure, which is generally in the range of 1-8 PSI and preferably about 5 PSI. It will be appreciated that the inflation pressure may vary considerably during use at the vehicle drives across it. However, the inflation pressure of the cushion is typically not particularly high during use due to the large contact area with both the underlying surface and the vehicle tire.

It should be noted, however, that the inflatable automotive traction recovery tool of the present invention may become operational for lighter vehicles at a lower pressure and larger vehicles may require pressures higher than 10 PSI.

It will be appreciated that as used herein, the term "inflate" refers to the introduction of a fluid substance into a vessel such as the cushion of the present invention, such that the vessel expands. Such fluid substance may be in the form of, but not limited to, a gas, a liquid or foam. Further, the term "forward" is used herein to refer to the desired direction of locomotion rather than the direction of the front of the vehicle.

The inflatable automotive traction recovery tool of the present invention is able to negotiate a wide variety of obstacles such as, but not limited to, bridging over a ditch, providing a ramp to climb a steep step, providing traction on soft ground and low friction surfaces, and providing support when one or more wheels of the vehicle lose contact pressure with the ground.

Practical testing shows that the inflatable automotive traction recovery tool of the present invention have a much better performance than previously known automotive traction recovery tools. When trying to start a vehicle from a situation from which it cannot pull itself out, there is a need for high driving torque. Such high torque can, and usually does, cause the wheel to spin. With previously known automotive traction recovery tools that are partially or fully rigid, the wheel spin can cause the traction recovery tool to be propelled from underneath the wheel before vehicle traction has been recovered.

The inflatable cushion recovery tool of the present invention literally cushions the motion of the tire and allows for smooth transmission of the driving torque to the ground via the tool. This is enhanced by the tubular construction of the cushion since the driving force is applied in a direction that is substantially parallel to the central axis of the tube.

The smooth transmission of power to the ground allows less competent drivers to recover their vehicle successfully, will reduce wear and tear of vehicle components such as, but not limited to, drive train components, and chassis and suspension components, and will help to reduce the environmental damage caused by the vehicle to the ground and the vegetation.

Figure 9:
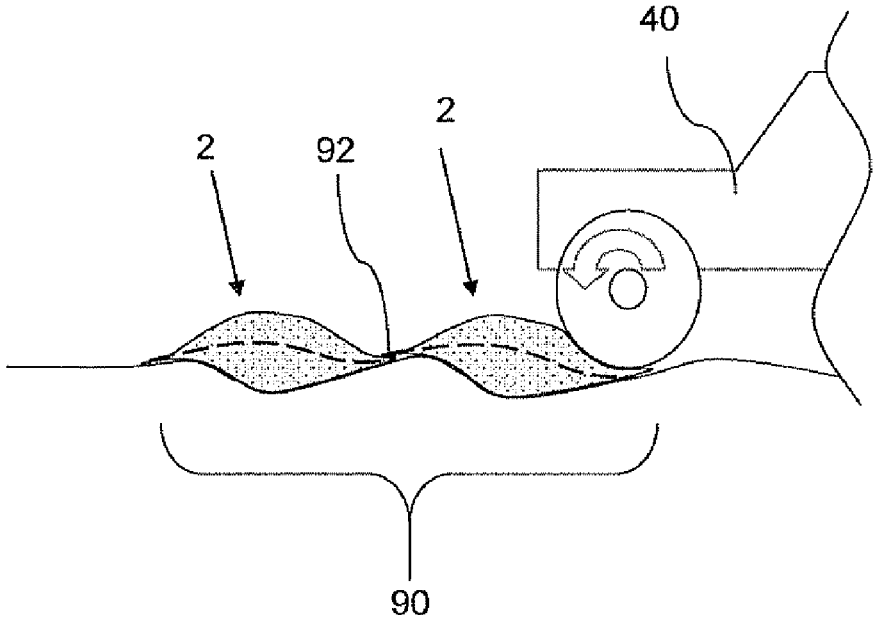
FIG. 9 is a schematic drawing illustrating a plurality of the inflatable automotive traction recovery devices of FIG. 1A being interconnected to provide a longer alternative driving surface.

As illustrated in FIG. 9, the inflatable automotive traction recovery tool of the present invention is modular and a plurality of cushions may be interconnected so as to increase the driving area provided by the inflatable automotive traction recovery tool. It will be readily understood that when providing traction on soft ground or low friction surfaces such as, but not limited to, sand, mud, ice and snow, inflatable cushions of the present invention can be deployed in front of each wheel. The cushions may also be connected so as to create a chain or "roadway" paved with cushions.

Figure 10:
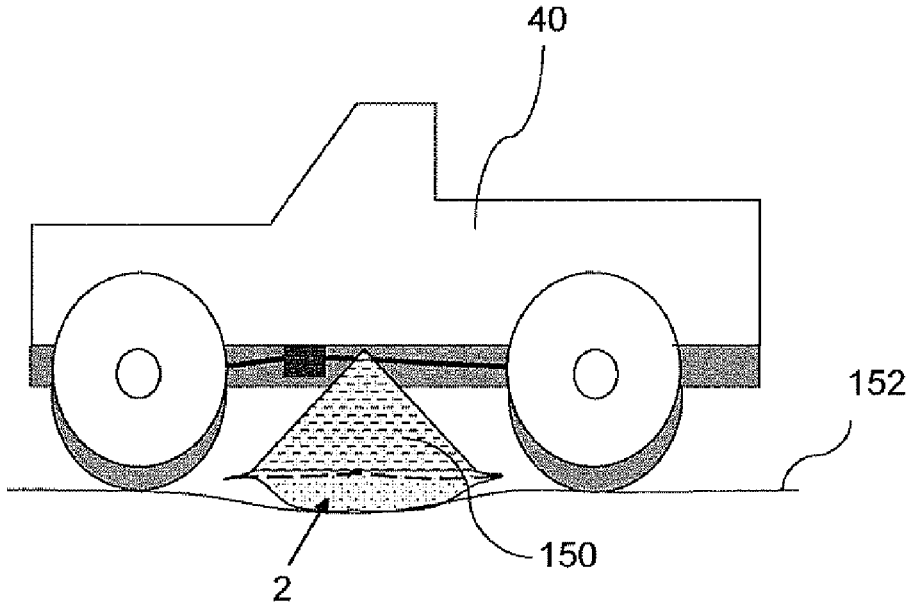
FIG. 10 is a schematic drawing illustrating the inflatable automotive traction recovery device of FIG. 1A as part of a vehicle jacking system.

An additional feature of the present invention, as illustrated in FIG. 10, is the deployment on the cushion of a pyramid shaped structure having a flat support surface at its apex thus allowing the cushion to function as a low pressure vehicle jack.

Referring now to the drawings, FIGS. 1A and 1B schematically illustrate a first preferred embodiment of the inflatable automotive traction recovery device of the present invention. As seen here, the inflatable automotive traction recovery device, herein generally labeled 2, is configured as an inflatable cushion having a substantially flattened tubular shape. That is, the inflatable cushion 2, when inflated to operational pressure such as, but not limited to, a range of between 1 PSI-20 PSI and with no external pressure exerted on it, has a substantially elliptical wall 4 that provides a top surface 6 suitable for a driving surface and a bottom surface 8 suitable for ground contact. The substantially elliptical wall 4 has a length that extends between two sealed ends 20 and 22. Although the device is effective for traction recovery when deployed in substantially any alignment to the direction of desired travel, it is preferable to deploy cushion 2 such that the central axis 12 of the tube is substantially parallel to the desired direction of locomotion of the vehicle.

The top 6 of the cushion is preferably configured as a high traction surface, as illustrated in FIG. 1C. This may be accomplished by the addition of traction elements 14. The traction elements may be integrally formed with cushion material at the time of fabrication. Alternatively, the traction elements may be configured as add-on components for attachment during the assembly of the inflatable automotive traction recovery device.

It should be noted that as used herein, the terms "inflatable automotive traction recovery device" and "inflatable cushion" are considered synonymous and are therefore interchanged throughout this document and both refer to the element in the drawings labeled 2 or 102.

Figure 4A:
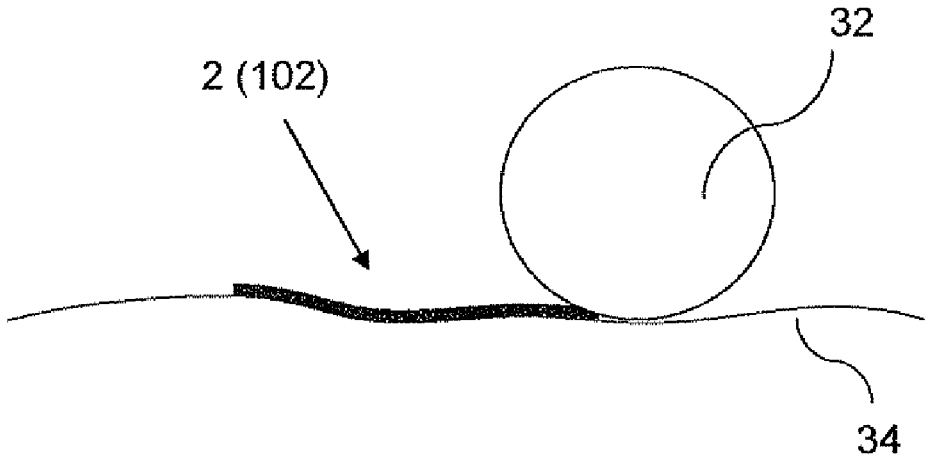
FIG. 4A is a schematic drawing illustrating the initial deployment of the inflatable automotive traction recovery device of FIG. 2A, before inflation.

During use as an alternative driving surface, the cushion 2 is deployed in an un-inflated state, as seen in FIGS. 1C and 4A, preferably with the central axis 12 of the tube substantially parallel to the driving direction of the vehicle as illustrated by line 10.

FIGS. 2A and 2B schematically illustrate a second preferred embodiment of the inflatable automotive traction recovery device of the present invention. As seen here, the inflatable automotive traction recovery device, herein generally labeled 102, is fabricated from a single sheet 100 of highly flexible non-stretchable material that is folded on itself and sealed along the edges 106, 108 and 110 of the remaining three open sides. This structure provides an inflated shape with three flat edges 106, 108 and 110 and one somewhat rounded edge 104. Pressurized air is introduced into the interior of cushion 102 through valve 116. Alternatively, the cushion may be configured such that all four sides are constructed the same such as, but not limited to, stitching around the perimeter of the cushion.

The top 112 of the cushion 102 is preferably configured as a high traction surface, as illustrated in FIG. 2C. This may be accomplished by the addition of traction elements 114. Here too, the traction elements may be integrally formed with cushion material at the time of fabrication. Alternatively, the traction elements may be configured as add-on components for attachment during the assembly of the inflatable automotive traction recovery device.

Figure 8:
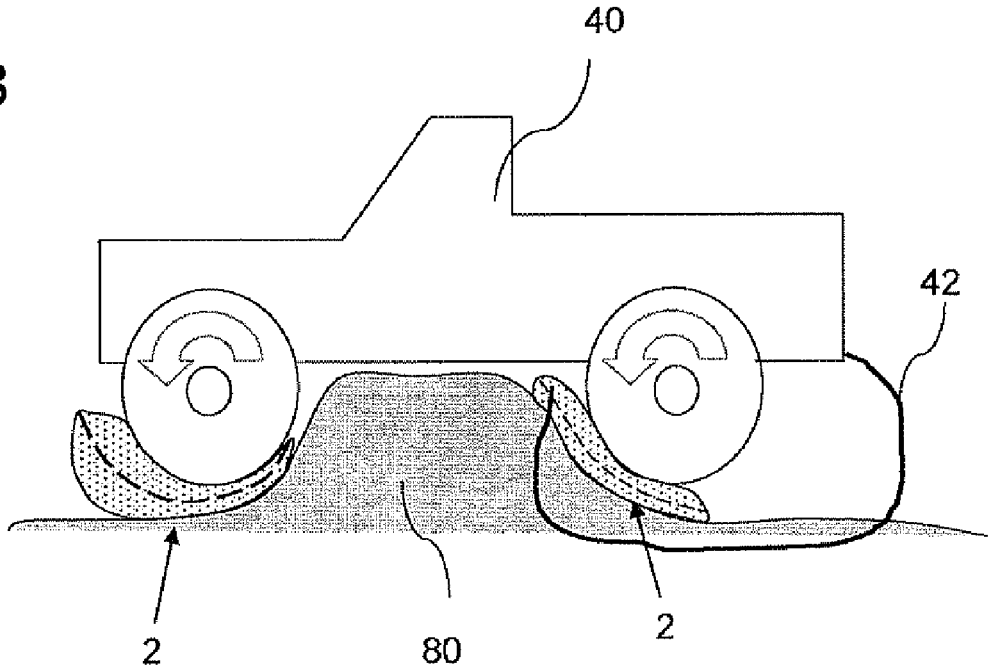
FIGS. 8 is a schematic drawing illustrating a plurality of the inflatable automotive traction recovery devices of FIG. 1A being used to provide extra ground height in order to prevent high-centering of a vehicle.

During use as an alternative driving surface, the cushion 102 is deployed in an un-inflated state, as seen in FIGS. 2C and 4A. Typically, the inflatable cushion 2 (102) is inflated to less than 10 PSI and preferably about 5 PSI. Pressurized air may be introduced into the interior volume of the inflatable cushion 2 (102) through a standard valve 16 as is commonly known in the art. As mentioned above, the cushion may alternatively be inflated by the introduction of liquids or foams into the interior volume of the inflatable cushion 2 (102). The highly flexible non-stretchable nature of the material from which the wall 4 (sheet 100) of the inflatable cushion 2 (102) is fabricated such that in an operationally-inflated state, typically in a range of 1-20 PSI and preferably in a range of 1-8 PSI, the bottom surface of the inflatable cushion 2 (102) is highly adaptable so as to conform to the terrain of the underlying surface (as best illustrated in FIG. 3B) and its top surface is likewise highly adaptable so as to conform to the footprint of the vehicle tire (as best illustrated in FIGS. 3B and 8). It should be noted that for very heavy vehicles, operational inflation pressure may be higher than 20 PSI.

Figure 3A:
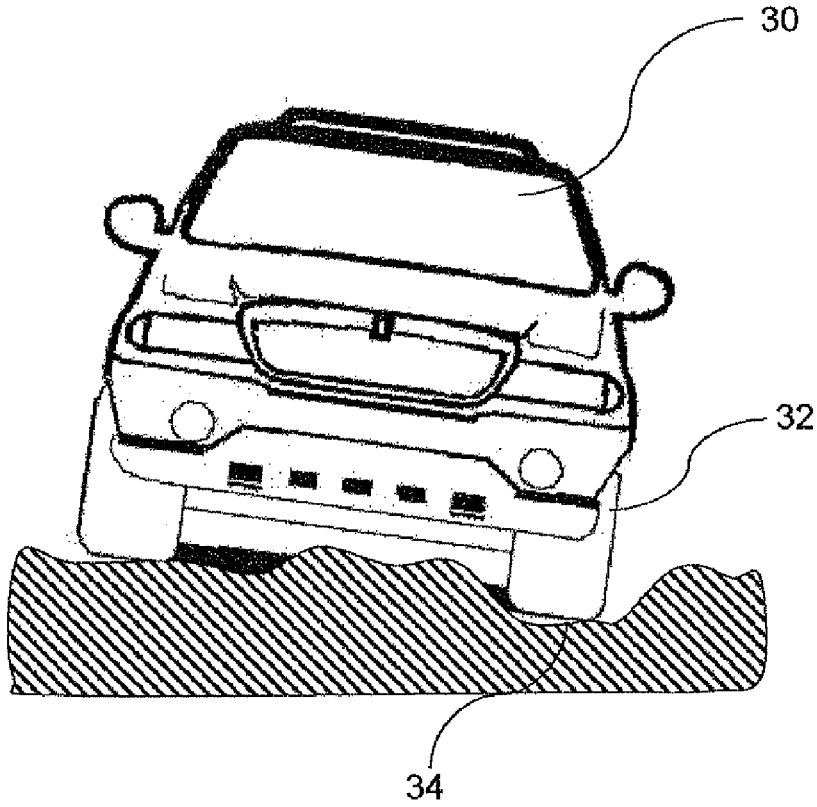
FIG. 3A is a schematic drawing of a vehicle one of whose wheels has lost locomotive contact with the underlying surface.
Figure 3B:
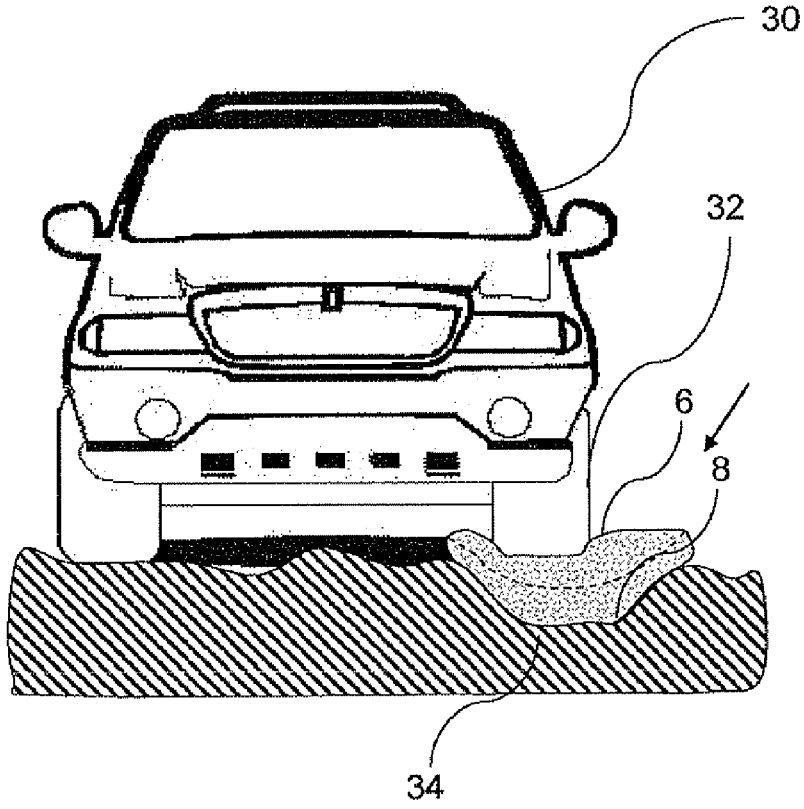
FIG. 3B is a schematic drawing illustrating deployment the embodiment of FIG. 1A as an alternative driving surface for the vehicle of FIG. 3A.

As illustrated in FIGS. 3A and 3B, the inflatable automotive traction recovery tool is well suited for situations where a tire 32 of a vehicle 30 has lost locomotive contact with the underlying surface 34.

FIG. 3B illustrates the inflatable automotive traction recovery tool 2 of the present invention as it has been deployed and inflated. In should be noted how the top surface 6 of the inflatable cushion 2 exhibits a high level of adaptability so as to readily conform to the shape (footprint) of tire 32. Likewise, the bottom surface 8 of inflatable cushion 2 is highly adaptable so as to readily conform to the terrain of the underlying surface 34.

Figure 4B:
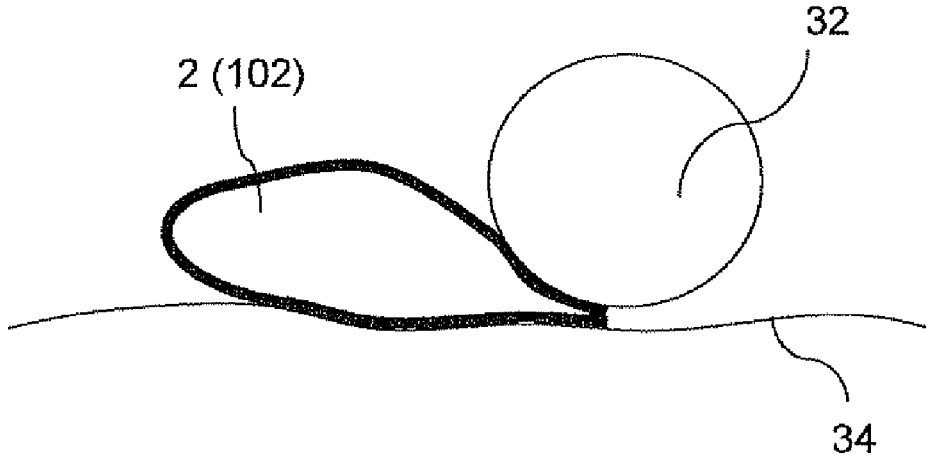
FIG. 4B is a schematic drawing illustrating of the inflatable automotive traction recovery device of FIG. 2A, after inflation and prior to driving.

As mentioned above, the cushion 2 (102) is deployed in an un-inflated state, as seen in FIG. 4A, forward of the problematic tire 32 in a direction of locomotion. Once deployed, the cushion 2 (102) is then inflated as seen in FIGS. 4B and 3B, so as to at least partially lift tire 32 off the underlying surface such that a significant tire load is supported by the cushion 2 (102) and simultaneously it provides a driving surface with sufficient pressure against the tire 32 and the underlying surface 34 to allow the vehicle 30 to drive on the cushion 2 (102).

This is quite different from the current methods for extracting a vehicle from such a situation. Currently, two separate steps are required. First a lifting tool, such a jack, is used to lift the vehicle high enough to raise the problematic wheel such that a remedy to the problem can be implemented. The remedy may include the deployment of a second tool, such as a sand ladder or bridge, or natural materials such as rocks or logs.

FIGS. 5-10 illustrate a variety of non-limiting applications for which the inflatable automotive traction recovery tool of the present invention is well suited.

Figure 5:
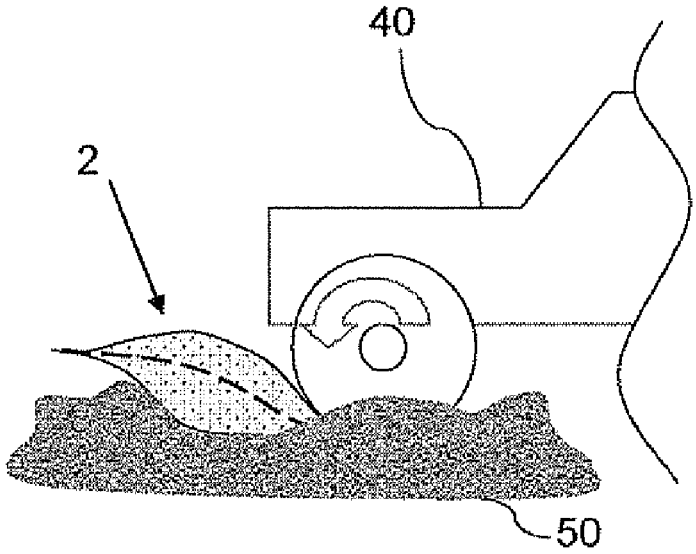
FIG. 5 is a schematic drawing illustrating the embodiment of the inflatable automotive traction recovery device of FIG. 1A being used on a low friction driving surface.

FIG. 5 illustrates the inflatable automotive traction recovery tool 2 deployed to recover lost traction to a vehicle 40 that is stuck where the underlying surface 50 is soft ground such as, but not limited to, sand or mud. Alternatively, underlying surface 50 may be a low friction surface such as, but not limited to, ice or snow.

Figure 6:
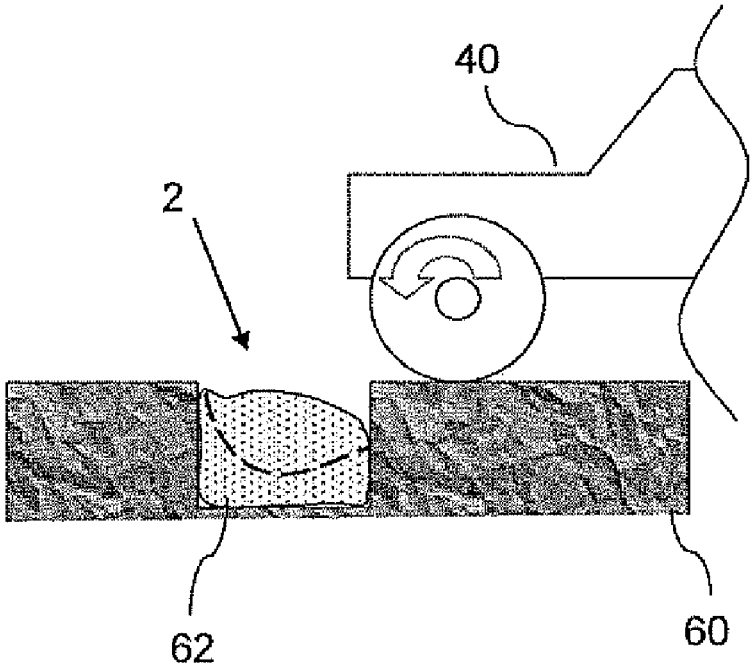
FIG. 6 is a schematic drawing illustrating the embodiment of the inflatable automotive traction recovery device of FIG. 1A being used to fill a ditch so as to allow passage of a vehicle.

FIG. 6 illustrates the inflatable automotive traction recovery tool 2 deployed to provide an alternative driving surface where the underlying surface 60 includes, by non-limiting example, a ditch 62. In this situation, the inflatable automotive traction recovery tool 2 is deployed prior to vehicle 40 entering the hazardous area.

Figure 7:
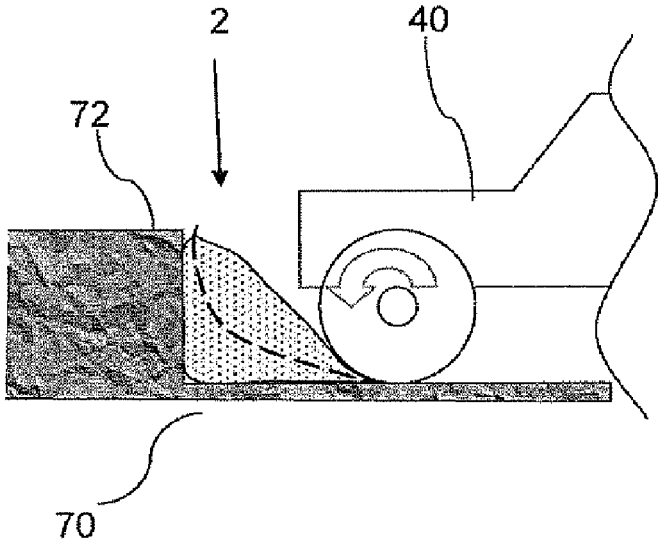
FIG. 7 is a schematic drawing illustrating the embodiment of the inflatable automotive traction recovery device of FIG. 1A being used to provide a ramped driving surface.

FIG. 7 illustrates the inflatable automotive traction recovery tool 2 deployed to provide a ramp to allow vehicle 40 to ascend the step like obstacle 72 occurring in the underlying surface 70.

FIG. 8 illustrates a plurality of inflatable automotive traction recovery tools 2 deployed to provide the vehicle 40 with the extra ground clearance necessary to pass over hump 80 without getting high-centered. It will be readily understood that such a maneuver may require four or more inflatable automotive traction recovery tools 2.

Also illustrated in FIG. 8 is the optional tether cord 42 that is attached at one end to the inflatable automotive traction recovery tool 2 and at the other end to the vehicle 40. This interconnection between the inflatable automotive traction recovery tool 2 and the vehicle 40 is especially helpful when extracting a vehicle from, for example, being stuck in sand. Once extracted from the sand, the driver may continue forward locomotion of the vehicle until reaching solid ground, thereby eliminating the need to stop while still on unstable ground, or alternatively walking back, to retrieve the traction recovery tool, as is the current common practice. This time saving feature is especially helpful in racing situations where time is of the essence.

FIG. 9 illustrates two inflatable automotive traction recovery tools 2 interconnected by attachment elements 92 (best illustrated in FIG. 1A) so as to form a chain of inflatable cushions. The chain is deployed to provide an extended alternative driving surface to vehicle 40 over a problematic or hazardous underlying surface 90. Such deployment may include recovery of lost traction to vehicle 40 as illustrated in FIG. 3. Alternately, the chain of inflatable automotive traction recovery tools 2 may be deployed prior to vehicle 40 entering the problematic driving area 90. It should be noted that the interconnection of a plurality of inflatable automotive traction recovery tools of the present invention need not be limited to the longitudinal interconnection illustrated here and that configurations with lateral interconnection only and both longitudinal and lateral interconnections are within the scope of the present invention. It will be understood the attachment elements 92 may be configured as substantially any suitable attachment device known in the art such as, but not limited to, snaps, loop and hook fasteners, and the like.

FIG. 10 illustrates the inflatable automotive traction recovery tool 2 fitted with an optional vehicle jack adaptor 150 so as to provide a stable vehicle jacking system to raise at least the body and frame of vehicle 40, and preferably at least one tire of vehicle 40 off the supporting ground surface 152. As illustrated here, the optional vehicle jack adaptor 150 is configured as a hollow pyramid that rests on the top surface of the inflatable automotive traction recovery tool 2. The combination of the cushion with attached vehicle jack adaptor is deployed in association with the vehicle needing to be raised. The vehicle jack adaptor 150 is configured to span most of the distance between the top surface of the inflatable automotive traction recovery tool 2, when in an un-inflated state, and a jacking point on the vehicle 40. As the inflatable automotive traction recovery tool 2 is inflated, the top of the vehicle jack adaptor 150 makes contact with the jacking point on the vehicle 40 and thereby concentrates the force created by the low pressure inflation of the cushion 2 to a single suitable raising point of the vehicle and lifts the vehicle. This is opposed to other low pressure inflatable jacks that apply pressure on a large area of the vehicle bottom, often causing damage to parts of the automobile not intended by the vehicle manufacturer to transmit the weight of the vehicle to the jack.

It will now be readily appreciated that the inflatable automotive traction recovery tool of the present invention, as illustrated by embodiment 2, may be used in place of a variety of prior art devices such as, but not limited to, sand bridges, and ladders, bridging sections and ramps, with the added benefit of also raising the vehicle. Further, when used with an optional jacking adaptor, the inflatable automotive traction recovery tool may be used as a stationary vehicle jack as well.

FIGS. 11A-11C illustrate a third preferred embodiment of the traction recovery tool 200 configured for use with narrow tires 210 such as, but not limited to, motorcycles and other two-wheeled vehicles.

As illustrated here, the traction recovery tool 200 is configured with two parallel substantially tube-like cushion elements 202 that are interconnected along substantially their entire length so as to form between them a groove 204 in which the tire 210 is driven.

It should be noted that the tube-like cushion elements may be constructed as two separate elements that are then interconnected along substantially their entire length. Alternatively, the traction recovery tool 200 may be constructed as a single cushion in which the top and bottom walls are joined along at least a portion, and preferably a majority, of their length. It will be appreciated that while it is preferable that both cushion elements may be inflated through a single inlet, embodiment in which each of the cushion elements is inflated separately is within the scope of the present invention.

As in the previous embodiments, here too as illustrated in FIG. 11B, the bottom surfaces of the cushion elements are highly adaptable so as to conform to the terrain of the ground on which it is deployed. The groove 204 formed between the two assists in providing conformity of the top surfaces of the cushions 202 to the footprint of the vehicle tire 210 as the vehicle is driven across the device. By adapting to the shape of the tire the traction recovery tool 200 of the present invention provides higher traction since it wraps around the tire.

FIG. 11C illustrates traction recovery tool 200 deployed forward of the rear tire 210 so as to provide traction in the sand. The traction recovery tool 200 is attached to the rear of the motorcycle by tether cord 242, thus enabling the driver to continue forward locomotion until attaining firm ground without having to stop to retrieve the traction recovery tool 200.

It will be appreciated that if necessary, an additional traction recovery tool 200 may be deployed forward of the front tire of the motorcycle as well.

It will be appreciated that the above descriptions are intended only to serve as examples and that many other embodiments are possible within the spirit and the scope of the present invention.

What is claimed is:

1. A method for providing an alternative driving surface for a motor vehicle, the alternative driving surface being an inflatable automotive traction recovery device deployable on an underlying surface, the method comprising:

(a) providing at least one inflatable cushion;

(b) deploying said at least one inflatable cushion in an un-inflated state forward of, and adjacent to, at least one wheel on the motor vehicle in a desired direction of locomotion;

(c) inflating said at least one cushion so as to simultaneously lift the vehicle and provide a driving surface; and (d) driving the motor vehicle on a top surface of said inflatable cushion;

wherein said at least one inflatable cushion is implemented such that in an operationally-inflated state said top surface and a bottom surface of said inflatable cushion are flexible in substantially all directions thereby allowing walls of said cushion to mold to and accommodate substantially any ground surface contour and a contour of a vehicle tire when weight of the vehicle is supported by said cushion, said cushion being free of any interior structures that limit the adaptability of the walls to the underlying surface or said contour of said vehicle tire.

2. The method of claim 1, wherein said at least one inflatable cushion is implemented having a substantially flattened tubular shape.

3. The method of claim 2, wherein said driving is in a direction that is substantially parallel to a central axis of said substantially flattened tubular shape.

4. The method of claim 1, wherein said at least one inflatable cushion is implemented as a fold sheet of material such that said inflatable cushion has one folded side and is sealed along the edges of its remaining three open sides.

5. The method of claim 1, wherein said inflating of said cushion is to an operational pressure of between 1-8 PSI.

6. The method of claim 1, further including providing at least one traction element attached to said top surface of said at least one inflatable cushion.

7. The method of claim 1, further including attaching a plurality of said inflatable cushions so as to increase a drivable area.

8. A method for providing an alternative driving surface for a motor vehicle, the alternative driving surface being an inflatable automotive traction recovery device deployable on an underlying surface, the method comprising:

(a) providing at least one inflatable cushion configured such that in an operationally-inflated state said at least one inflatable cushion is flexible in substantially all directions thereby allowing walls of said cushion to mold to and accommodate substantially any ground surface contour and a contour of a vehicle tire when weight of the vehicle is supported by said cushion, said cushion being free of any interior structures that limit the adaptability of the walls to the underlying surface or said contour of said vehicle tire; and (b) driving the motor vehicle on a top surface of said at least one inflatable cushion while said at least one inflatable cushion is in said operationally-inflated state.

9. The method of claim 8, further including driving the motor vehicle on said top surface of said at least one inflatable cushion is in a direction that is substantially parallel to a central axis of a substantially flattened tubular shape of said cushion.

10. The method of claim 8, wherein said at least one inflatable cushion is implemented as two parallel substantially tube-like cushion elements that are longitudinally interconnected along substantially their entire length so as to form between them a groove in which at least one tire of the vehicle is driven.

11. An inflatable automotive traction recovery device for use with a motor vehicle on a underlying surface, the inflatable automotive traction recovery device comprising at least one inflatable cushion configured with a bottom surface that conforms to the terrain of an underlying surface and a top surface that conforms to a contour of a vehicle tire, wherein said bottom surface and said top surface are flexible in substantially all directions thereby allowing walls of said cushion to mold to and accommodate substantially any ground surface contour and a contour of a vehicle tire when weight of the vehicle is supported by said cushion, said cushion being free of any interior structures that limit the adaptability of the walls to said underlying ground surface or said contour of said vehicle tire, such that inflating said at least one cushion simultaneously lifts the motor vehicle and provides a driving surface.

12. The inflatable automotive traction recovery device of claim 11, wherein said cushion has a substantially flattened tubular shape.

13. The inflatable automotive traction recovery device of claim 12, wherein a preferred driving direction is substantially parallel to a central axis of said substantially tubular shape.

14. The inflatable automotive traction recovery device of claim 11, wherein said cushion is fabricated from a sheet of material that is folded on itself and sealed along the edges of its remaining three open sides.

15. The inflatable automotive traction recovery device of claim 11, wherein said at least one inflatable cushion is configured as two parallel substantially tube-like cushion elements that are longitudinally interconnected along substantially their entire length so as to form between them a groove in which at least one tire of the vehicle is driven.

16. The inflatable automotive traction recovery device of claim 11, wherein said top surface includes at least one traction element.

17. The inflatable automotive traction recovery device of claim 11, further including at least one attachment element configured to facilitate attachment of a plurality of said inflatable cushions so as to increase a drivable area.

18. The inflatable automotive traction recovery device of claim 11, wherein said at least one inflatable cushion is inflatable by the introduction of pressurized air into an interior volume of said cushion.

19. The inflatable automotive traction recovery device of claim 11, wherein said at least one inflatable cushion is inflatable by the introduction of pressurized liquid into an interior volume of said cushion.

20. The inflatable automotive traction recovery device of claim 11, wherein said at least one inflatable cushion is inflatable by the introduction of a foam into an interior volume of said cushion.

21. The inflatable automotive traction recovery device of claim 11, further including a vehicle jacking adaptor configured for deployment on said top surface of said inflatable cushion for deployment in association with a vehicle, with said vehicle jacking adaptor spanning at least a portion of a distance between said top surface of said inflatable cushion in an un-inflated stated and a jacking point on a vehicle, and as said inflatable cushion is inflated said jacking adaptor contacts said jacking point and at least a portion of said vehicle is lifted.

22. The inflatable automotive traction recovery device of claim 11, wherein said at least one inflatable cushion is fabricated from material that is highly flexible and non-stretching.

23. A method for providing an alternative driving surface for a motor vehicle, the alternative driving surface being an inflatable automotive traction recovery device deployable on an underlying surface, the method comprising:

(a) providing two parallel substantially tube-like cushion elements that are interconnected along substantially their entire length so as to form between them a groove;

(b) deploying said two parallel substantially tube-like cushion elements adjacent to at least one wheel on the motor vehicle in a desired direction of locomotion;

(c) inflating said cushion elements so as to provide a driving surface; and (d) driving the motor vehicle such that at least one tire of the vehicle is driven in said groove;

wherein said at least one inflatable cushion is implemented such that in an operationally-inflated state a bottom surface of said inflatable cushion is adaptable so as to conform to the terrain of the underlying surface and a top surface of said inflatable cushion is adaptable so as to conform to a contour of a vehicle tire.

* * * * *